US005099757A

United States Patent [19]

Jennings

[11] Patent Number: 5,099,757

[45] Date of Patent: Mar. 31, 1992

[54] SPRING RATE CONTROL IN A SCREEN PRINTING DEVICE

[75] Inventor: Roger Jennings, Queensbury, N.Y.

[73] Assignee: R. Jennings Manufacturing Co., Inc., Glen Falls, N.Y.

[21] Appl. No.: 569,446

[22] Filed: Aug. 20, 1990

[51] Int. Cl.[5] ..... B41F 15/10; B41F 15/34

[52] U.S. Cl. ..... 101/115; 101/127.1; 101/129; 16/290; 267/168

[58] Field of Search ..... 101/114, 115, 126, 127.1, 101/129; 267/168, 290, 89, 92; 16/305, 306, 289, 290, 298

[56] References Cited

U.S. PATENT DOCUMENTS

| | | | |
|---|---|---|---|
| 1,329,561 | 2/1920 | Thompson | 74/582 X |
| 2,222,146 | 11/1940 | Jonsson | 267/168 |
| 2,641,795 | 6/1953 | James et al. | 16/290 |
| 2,704,510 | 3/1955 | Walsh, Jr. | 101/123 |
| 3,737,947 | 6/1973 | Little | 16/290 |
| 3,902,694 | 9/1975 | Friedell | 251/58 |
| 3,905,403 | 9/1975 | Smith et al. | 267/168 X |
| 3,930,669 | 1/1976 | Kollander et al. | 280/426 |
| 4,004,611 | 1/1977 | Friedell | 137/614 |
| 4,285,676 | 8/1981 | Kraft | 267/155 X |
| 4,290,624 | 9/1981 | Storandt | 280/634 |
| 4,499,981 | 2/1985 | Nagano | 192/106.2 |
| 4,640,500 | 2/1987 | Shiau | 267/168 |
| 4,679,682 | 7/1987 | Gray et al. | 192/21 |
| 4,907,506 | 3/1990 | Davis et al. | 101/115 |

FOREIGN PATENT DOCUMENTS

| | | |
|---|---|---|
| 3801783 | 7/1989 | Fed. Rep. of Germany . |
| 3819345 | 12/1989 | Fed. Rep. of Germany . |

OTHER PUBLICATIONS

Ranar Manufacturing Company brochure, Model P-110 Manual T-Shirt Printer.

Antec Incorporated brochure, "Screen Printing Equipment Engineered For The Hands".

*Primary Examiner*—Clifford D. Crowder

*Attorney, Agent, or Firm*—Nixon & Vanderhye

[57] ABSTRACT

A screen printing machine including a head and at least one screen frame holding arm pivotally mounted on the head for movement about an axis toward and away from a platen between lowered printing and raised non-printing positions, respectively, is provided which includes primary springs associated with the screen frame holding arm, the primary springs attached at one end to first attachment locations on the arm and at another end to second attachment locations on the head for controlling the movement of the arm. Secondary springs for adjusting the spring rate of the primary springs are also provided, the secondary springs in one embodiment extending between the same first and second attachment locations.

14 Claims, 3 Drawing Sheets

SPRING RATE CONTROL IN A SCREEN PRINTING DEVICE

BACKGROUND AND SUMMARY OF THE INVENTION

This invention relates to screen printing apparatus and specifically, to an improved device for controlling and adjusting the spring rate associated with the screen holding arms usually associated with such apparatus.

Printing machines in the screen printing industry typically print small cap images and larger T-shirt images. In most cases, printers use wood or aluminum frames of various sizes, typically a 9"×12" for caps and a 20"×22" for T-shirts and the like. In the case of wood, typically a soft wood such as pine, which has the advantage of being light in weight, is employed in the frame construction, with individual frame sides generally about 1 inch thick and about 1½ inches wide.

There are instances, however, where oversize frames are required for even larger images such as for pant legs, sleeves, decorative banners, etc., and in those cases where more than one image is to be provided on a single screen. In such cases, the oversize frames are significantly heavier than the largest of the normally used frames, i.e., the 20"×22" frame. In fact, it is known to use 2×4's constructed from Kiln-dried hard wood in the construction of oversize frames. These larger frames have proven to be difficult and even unworkable, when used with conventional screen printing machines primarily due to their increased weight.

In a typical screen printing machine, a screen (or screen frame) holding arm is mounted for pivotal movement between a printing, or down, position to a non-printing, or up, position relative to a platen upon which rests the item to be printed. The screen holding arm is generally provided with a clamping or holding mechanism which grips a screen of the type described hereinabove. Most such machines employ coil extension springs extending between the machine head and a point intermediate the ends of the screen holding arm, to control movement of the screen and screen holding arm from the printing to the non-printing position and vice versa. Of course, these springs are designed to extend only to certain length, beyond which the spring is subject to permanent damage from plastic deformation. The springs currently in use in the screen printing industry are sufficient to handle the normal range of frame sizes up to the 20"×22" size, and even slightly larger. However, for substantially larger and heavier frames, these springs are not sufficient as explained below.

In conventional screen printing machines, using conventional screen sizes, the inner point of attachment of the spring, i.e., at the machine head, is generally slightly below the pivot point of the screen holding arm. Typically, when the screen is raised to a non-printing position (generally about 60° from horizontal) and released, it will remain in the raised position. At the same time, when the arm is lowered to a printing position, the arm will remain lowered, with the screen in contact with the item to be printed, so that the operator can use both hands to print the cap, T-shirt or other items.

When oversize frames are utilized in such machines, the weight of the frame overcomes the spring tension so that the frame will not stay in the up, or non-printing position. Thus, the operator must support the screen in the raised position to prevent it from falling to the lower, or printing position. This, of course, is an undesirable and even unworkable situation.

If larger, stiffer springs are used to accommodate these oversize frames, the overall flexibility of the machine is reduced because the operator cannot thereafter switch back to the smaller, lighter cap or T-shirt frames. This is because the larger, stiffer springs will keep the lighter frames in a normally biased upward position so that an operator would not be able to release the frame after lowering it into a printing position. It is, of course, important that the operator be able to free his hands to print the image when the frame is lowered. Thus, in the past, moving between extreme frame sizes thus involved a time consuming change of springs as well. In addition, the stiffer larger springs employed for oversize frames are typically made of hardened steel, and create a substantial risk of injury in the event of breakage.

Other approaches have been taken when utilizing the larger frames for controlling the movement of the screen holding arms. For example, compression rather than extension springs have been tried, as have pressurized compression gas cylinders. However, compression springs have usually not proven to be satisfactory and, in the case of gas cylinders, there typically is no ability to adjust the cylinders to change the rate at which the connecting (piston) rod extends or retracts within the cylinder.

Other manufacturers have employed turnbuckles attached to the end of the extension springs to regulate the tension, or extension, of the spring. It has also been attempted to employ four springs, rather than two, for each screen holding arm. Neither of these techniques has met with any significant degree of acceptance in the trade.

In commonly assigned U.S. Pat. No. 4,907,506, improvements are disclosed which relate to an ability to adjust not only the spring rate, but also to adjust the degree of leverage to facilitate movement of the screen holding arm between the printing and non-printing positions by adjusting the points of attachment of the springs to the machine frame.

In this present invention, another approach is taken to provide a degree of adjustability for spring rates in otherwise conventional screen holding arms. Specifically, a secondary spring is provided as an add-on for use with each of the primary coil springs associated with conventional screen holding arms. In other words, for each pair of coil springs utilized in conjunction with a screen holding arm, a secondary spring is operatively associated with a respective one of the coil springs to provide an additional degree of adjustability to the spring rate of the primary springs. In one exemplary embodiment, these "internal" or secondary springs may also be coil springs attached, for example, to the same attachment points as the primary springs, and which extend, for example, through the center of the primary coil springs.

It is contemplated that a number of different secondary spring pairs, each with a different spring rate, can be selectively chosen to provide the desired overall spring rate and hence the desired movement of the screen holding arm.

In another exemplary embodiment, still further adjustability may be provided by attaching the secondary or internal springs to turnbuckle-type attachments so that the spring rate of each secondary spring pair can be altered in situ, i.e., without having to change the internal springs themselves.

In still another exemplary embodiment, adjustment of spring rate can be effected by attaching the secondary springs, at different times, directly to different coils of the primary springs. In other words, the larger the number of primary coils encompassed by the secondary spring, the greater will be the effect of the secondary spring on the primary spring rate.

In its broadest aspects, therefore, the present invention provides a screen printing machine including a head and at least one screen frame holding arm pivotally mounted on the head for movement about an axis toward and away from a platen to a lowered printing and raised non-printing positions, respectively, and including primary spring means associated with the at least one arm, the primary spring means attached at one end to first attachment means located on at least one arm and at another end to second attachment means located on the head for controlling the movement of at least one arm; the improvement comprising secondary spring means for adjusting the spring rate of the primary spring means.

The invention also relates to a method for adjusting the spring rate of a pair of primary springs attached at first ends to first attachment locations on a screen frame holding arm of a screen printing machine, and at second ends to second attachment locations on a machine head of the screen printing machine comprising the steps of:

a) providing a plurality of secondary spring pairs, having different spring rates;

b) selecting one of the secondary spring pairs as a function of the spring rates; and c) mounting the selected one of the secondary spring pairs in operative association with the pair of primary springs.

Additional object and advantages of the subject invention will become apparent with the detailed description of the invention which follows.

DETAILED DESCRIPTION OF THE DRAWINGS

Figure 1:
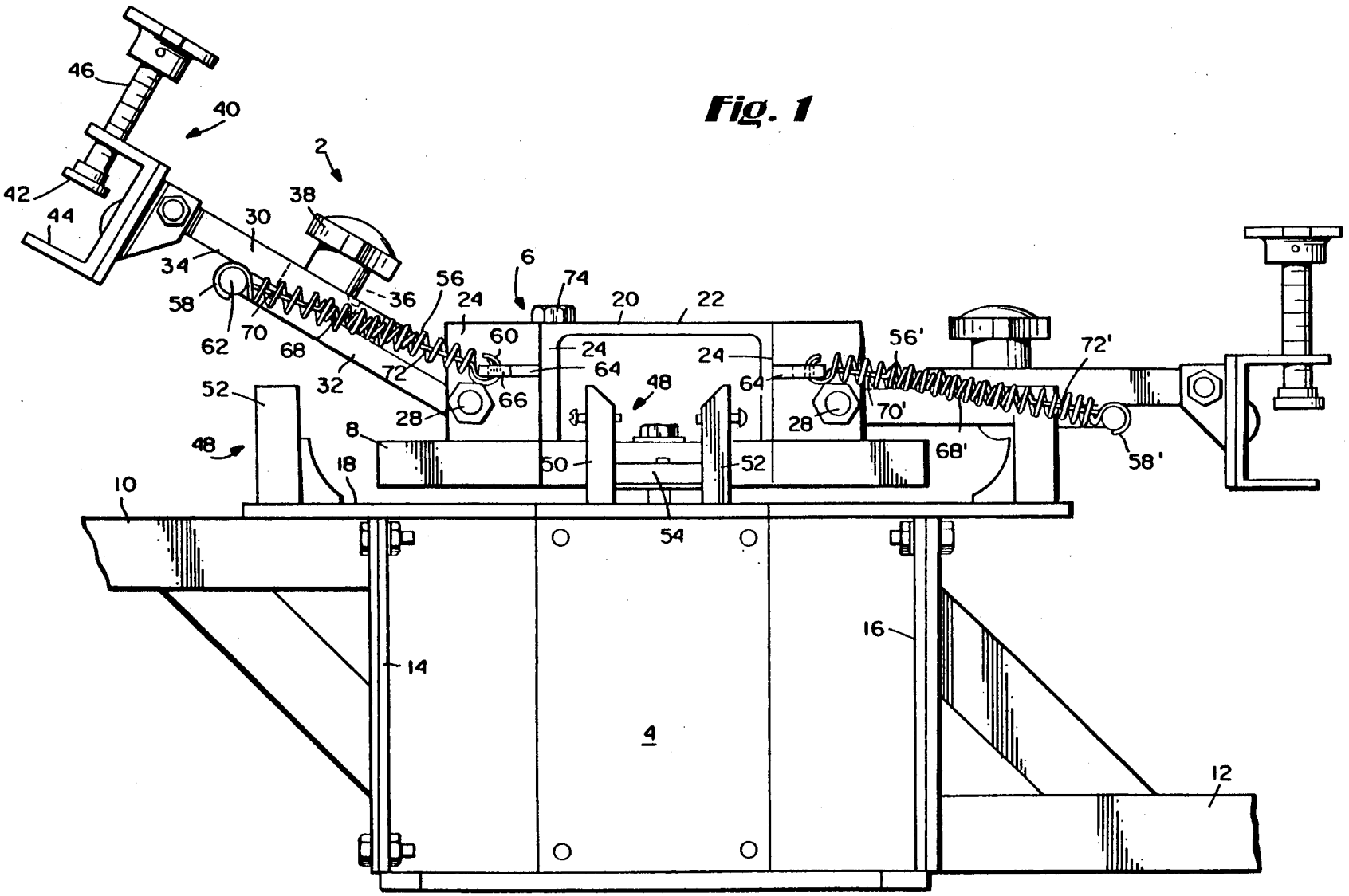
FIG. 1 is a partial side view of a four color screen printing device in accordance with an exemplary embodiment of the present invention with certain parts removed for clarity.
Figure 2:
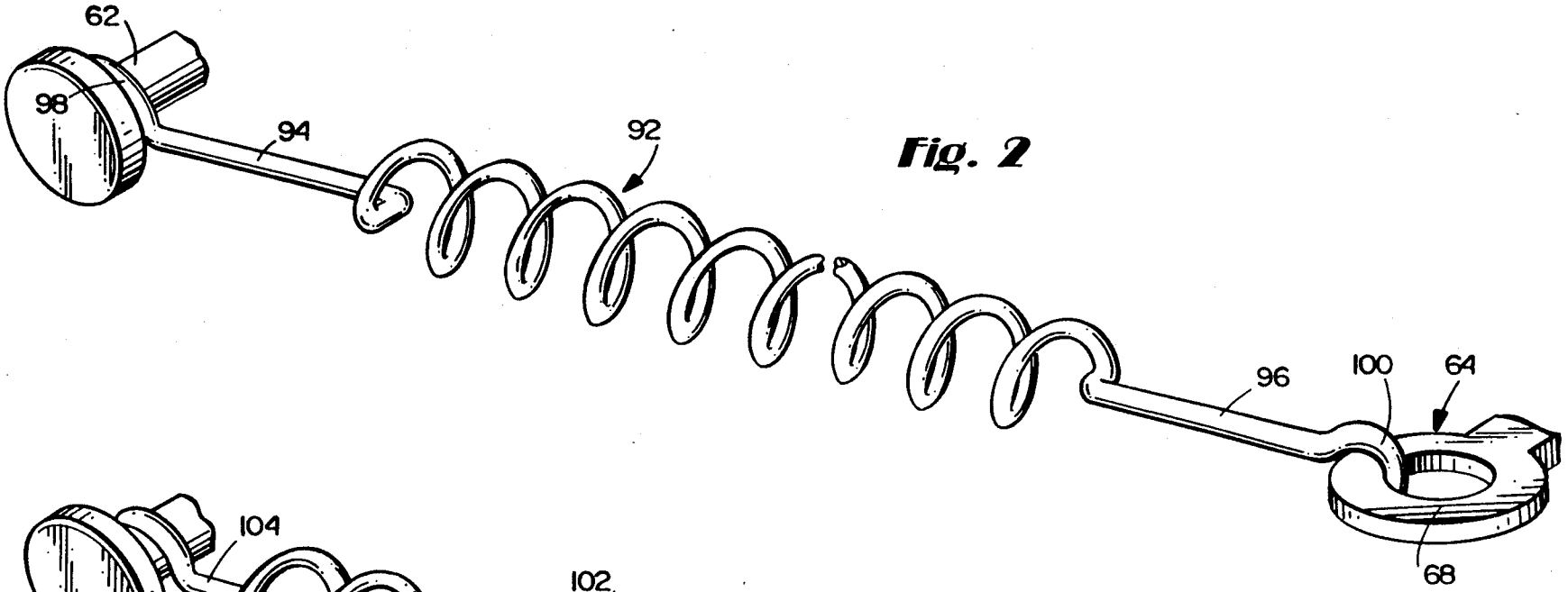
FIG. 2 is an isolated perspective view of a secondary spring attachment used in the apparatus shown in FIG. 1.

Referring now to FIGS. 1 and 2, a four color screen printing machine 2 is illustrated which includes a base structure or frame 4, and a head 6 mounted on a manually rotatable turntable 8. Platen support arms 10 and 12 are mounted on vertical wall surfaces 14, 16 on opposite sides of the base 4 and two additional platen support arms (not shown) may be mounted perpendicularly with respect to support arms 10 and 12 to form a four color printing device with four work stations fixedly mounted at 90° intervals about the base 4. It will be understood that the base of the machine, the manner in which the turntable 8 is rotatably mounted on the top surface 18 of the base 4, and the details of the platen support arms 10 and 12 form no part of this invention and need not be described further.

The head 6 may be made up of four identical, inverted U-shaped channel members, the description of one of which suffices for all. The channels 20 each include a top surface 22 and a pair of vertical walls 24 depending therefrom. It will be understood that each channel may be a single piece of metal bent or forged in a channel shape, or it may be a three piece assembly welded together as will be understood by those of ordinary skill in the art. The channels are so positioned on the turntable 8 as to define a substantially hollow central housing 26.

Pivotally mounted to the head 6 by pivot pins 28 are four screens, i.e., screen frame holding arms 30, mounted at 90° intervals about the head 6 so that any given time, four separate operations may be performed, one at each of the four platens mounted on the platen support arms. For example, a four color image may be printed on an item of sportswear, such as cap, with one color being applied at each station. Alternatively, a single color image may be applied to a different item at each station. Since each of the screen holding arms is identical to the next, only one need be described herein in detail.

Referring specifically to the screen holding arm 30 mounted on the left hand side of the machine illustrated in FIG. 1, it will be seen that the arm is pivotally mounted by the pivot pin 28 which extends horizontally through side walls 24 of the associated channel member 20. The arm 30 may include an inner section 32 and an outer section 34 which are slidable with respect to each other, and adjustable by reason of a slot 36 formed in outer section 34, and an adjustment bolt 38 to effectively shorten or lengthen the screen holding arm, so as to enable precise alignment of the arm with respect to a platen on the support arm 10. At the far end of the outer section 34, there is mounted a screen frame clamp 40 which includes a movable jaw 42 and a fixed jaw 44. Movable jaw 42 is part of an adjustable screw 46. The particular details of the screen clamp are well known in the art and need not be further described.

A guide/stop 48 is provided for the screen holding arm 30 on the horizontal top frame surface 18 of the base 4. The guide/stop includes spaced, vertical wall sections 50, 52 and a cross-piece 54 to form a substantially U-shaped cradle for receiving an associated screen holding arm generally aligned therewith.

A pair of coil extension springs 56, 56' are mounted on either side of each screen holding arm 30, each spring be provided with a first attachment hook 58, 58' and a second attachment hook 60, 60', respectively. The first attachment hooks 58, 58' are affixed to a rod 62 which extends substantially perpendicular to the arm 30 and which is fixedly secured as by welding to the outer edge of the inner arm section 32. The second attachment hooks 60, 60' may be attached to spring connections 64 including fixed eyelets 66 or other suitable connection means, e.g., a rod similar to rod 62.

This invention specifically relates to the use of a secondary spring in conjunction with each of the primary coil extension springs 56, 56'. Specifically, a smaller secondary spring 68, shown isolated for clarity in FIG. 2, and which is preferably in the form of a coil spring having elongated stem portions 70, 72 at either end thereof, is located within the central cylindrical core of each of the springs 56, 56'. One stem portion may be secured to the rod 62, while the other stem portion may be attached to the eyelet 66 of the connector 64 by any suitable arrangement such as by the use of hooks 74, 76 formed on the stem end portions. By inserting secondary springs 68 and 68' on either side of the screen arm 30 within the coil springs 56, 56', the spring rate of the coil springs 56, 56' is effectively changed.

It will be understood by those of ordinary skill in the art, that a variety of secondary spring pairs 68, 68' can be provided with preselected spring rates so that the operator of the machine can selectively choose a pair of secondary or internal springs with a desired spring rate, which will serve to alter the spring rate of the primary coil springs, and attach them to the screen holding arm in the manner described above. In this way, a further degree of adjustability and predictability is provided for controlling the movement of each of the screen arms 30.

Figure 3:
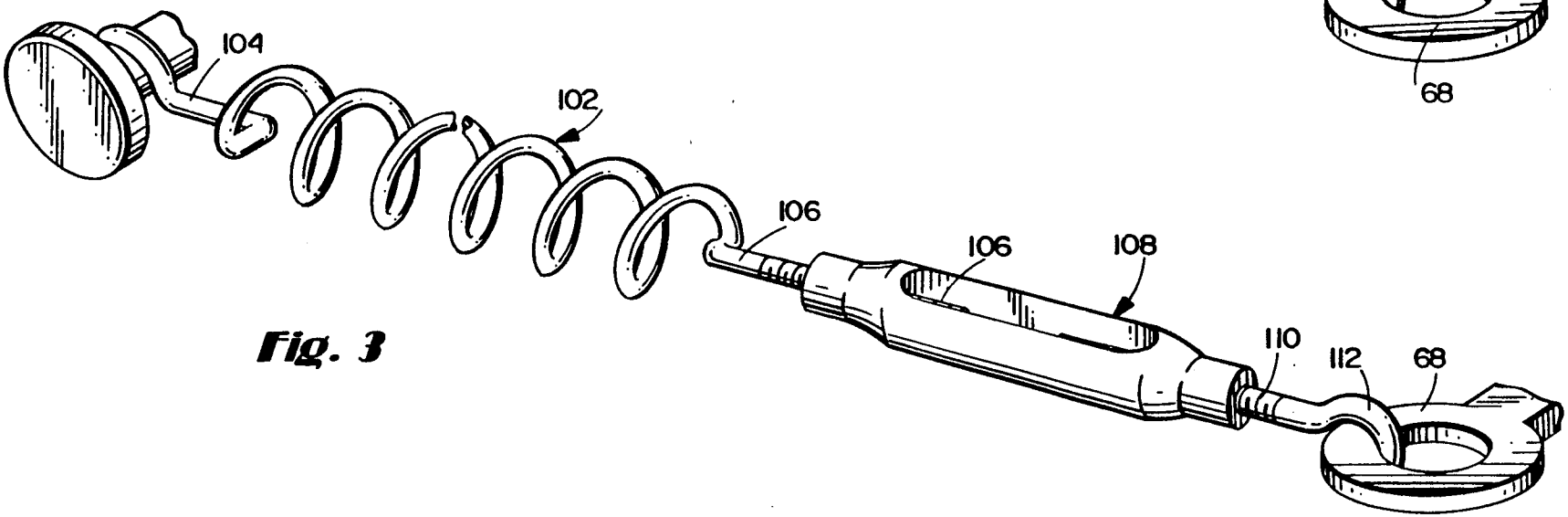
FIG. 3 is an isolated perspective view of another embodiment of a secondary spring attachment for use in the apparatus shown in FIG. 1.

In FIG. 3, there is shown another embodiment of the secondary spring construction in accordance with the invention. Specifically, a secondary spring 78 having elongated stem portions 80 and 82 is connected to the eyelet 66 through a turnbuckle device 84. The latter may be of conventional construction, including a threaded stud portion 86 extending outwardly from one side of the turnbuckle 84 and provided with a hook 88 engageable with eyelet 66. The stem 82 may be threaded and may be received directly in the turnbuckle 84. The spring rate of the secondary spring 78 (and therefore also of the primary coil spring) can be adjusted as desired simply by rotating the turnbuckle 84, without having to substitute another secondary spring having a different spring rate.

Figure 4:
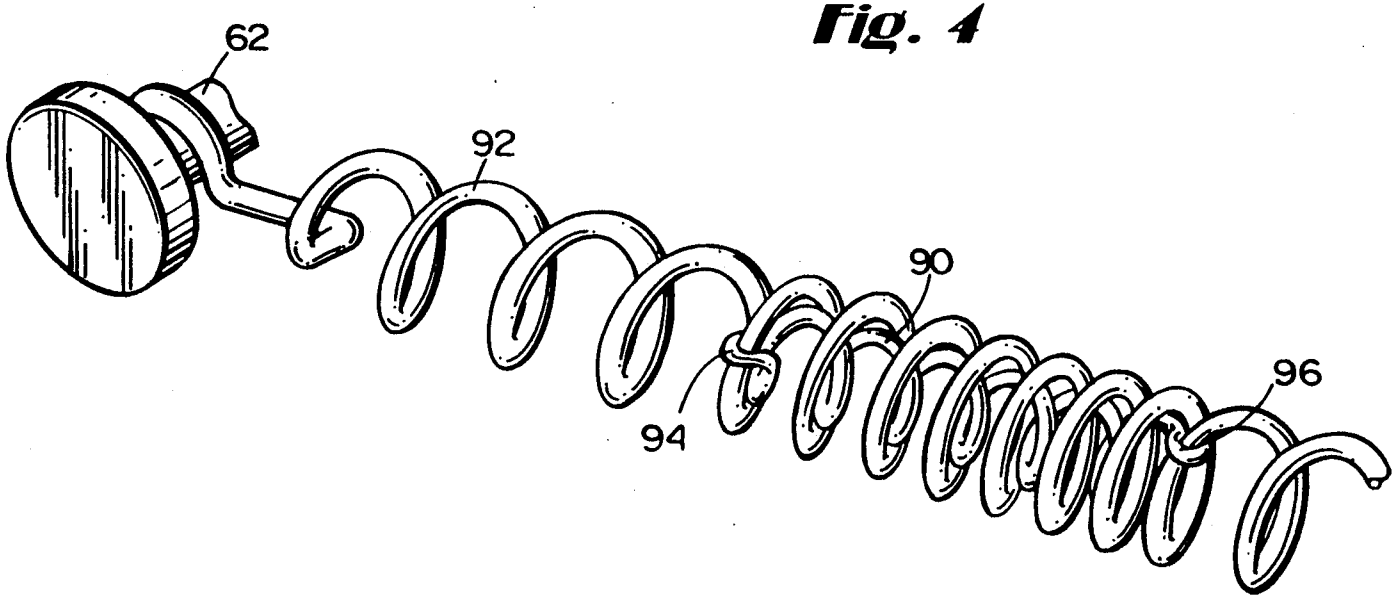
FIG. 4 is an isolated perspective view showing a connection between a primary and secondary spring in accordance with a third exemplary embodiment of the invention.

Referring to FIG. 4, in another exemplary embodiment of the invention, a secondary spring 90 is attached directly to selected coils of a primary spring 92. By adjusting the number of coils of the primary spring which are sandwiched between the hooks 94, 96 of the spring 92, the spring rate of the primary spring can be altered. For example, as the number of coils of primary spring 92 braced by the hook portions 94, 96 of the secondary spring increases, the effect of secondary spring 90 on the spring rate of the primary spring 92 also increases.

By thus incorporating spring rate changing means of the print screen apparatus, virtually unlimited rate adjustments can be made to provide the desired movement for each of the spring arms.

In a related aspect of the invention, a method is provided for adjusting the spring rate of the pair of primary springs 56, 56' attached at first ends to first attachment locations 62 on a screen frame holding arm 30 of a screen printing machine 2, and at second ends to a second attachment locations 64 on a machine head of the screen printing machine comprising the steps of:

a) providing a plurality of secondary spring pairs (e.g., 68, 68'), having different spring rates;

b) selecting one of the secondary spring pairs as a function of the spring rates; and c) mounting the selected one of the secondary spring pairs in operative association with the pair of primary springs 56.

As will be appreciated from the disclosure above, the method may include attachment of the secondary springs to the same attachment locations used for the primary springs, or attachment directly to the coils of the primary springs. Turnbuckle devices may also be used to add a further degree of adjustability.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a screen printing machine including a head and at least one screen frame holding arm pivotally mounted on said head for movement about an axis toward and away from a platen to lowered printing and raised non-printing positions, respectively, and including primary spring means associated with said at least one arm, said primary spring means attached at one end to said at least one arm and at another end to said head for controlling the movement of said at least one arm; the improvement comprising secondary spring means for adjusting the spring rate of said primary spring means, said secondary spring means also attached at its one end to said at least one arm and at its other end at least indirectly to said head.

2. The screen printing machine according to claim 1 wherein the primary spring means includes a first pair of coil springs and said secondary spring means includes a second pair of coil springs.

3. The screen printing machine according to claim 2 wherein a turnbuckle is mounted between each of said second pair of coil springs and said head.

4. In a screen printing machine including a head and at least one screen frame holding arm pivotally mounted on said head for movement about an axis toward and away from a platen to lowered printing and raised non-printing positions, respectively, and including primary coil spring means associated with said at least one arm, said primary coil spring means attached at one end to first attachment means located on said at least one arm and at another end to second attachment means located on said head for controlling the movement of said at least one arm, the improvement comprising secondary spring means for adjusting the spring rate of said primary coil spring means, said secondary spring means extending between and fastened to said first and second attachment means within said primary coil spring means.

5. The screen printing machine according to claim 4 wherein the primary coil spring means includes a first pair of coil springs and the secondary spring means comprise a second pair of coil springs.

6. The screen printing machine according to claim 5 wherein a turnbuckle is mounted between each coil spring of said second pair of coil springs and said second attachment means.

7. The screen printing machine according to claim 5 wherein said secondary pair of coil springs is interchangeable with other pairs of secondary coil springs having different spring rates.

8. A screen printing machine comprising a base, a rotary head mounted on said base, a plurality of arms extending radially outwardly from said rotary head, each arm having a screen frame holder mounted at its distal end, wherein said rotary head is indexable to a plurality of printing platens and wherein each arm is mounted for pivotal movement toward and away from said platens about a horizontal axis; at least one pair of primary coil springs associated with each arm, each of said pair of primary springs attached directly to said arm at first ends thereof and directly to attachment means on said head at second ends thereof, and a pair of secondary springs for adjusting the spring rate of said at least one pair of primary springs, said secondary springs each fastened at one end thereof directly to said arm and at the other end thereof to said head.

9. A screen printing machine as defined in claim 8 wherein said primary spring means includes at least one pair of coil extension springs, one on either side of said at least one arm.

10. A screen printing machine as defined in claim 8 wherein said secondary spring means includes a second pair of coil extension springs, each extending at least partially within a respective one of said pair of primary coil springs.

11. A method for adjusting the spring rate of a pair of primary springs attached at first ends to first attachment locations on a screen frame holding arm of a screen printing machine, and at second ends to second attachment locations on a machine head of the screen printing machine, comprising the steps of:

a) providing a plurality of secondary coil spring pairs, having different spring rates;

b) selecting one of said secondary coil spring pairs as a function of said spring rates; and c) mounting said selected one of said secondary coil spring pairs in operative association with said pair of primary springs, such that first ends of said secondary coil springs are attached directly to said first attachement locations on said screen holding arm, and second ends of said secondary coil springs are attached at least indirectly to said second attachment locations on said machine head.

12. The method of claim 11 wherein the pair of primary springs comprises a pair of first coil springs.

13. The method of claim 11 and including the further step of mounting a turnbuckle between each of the secondary springs and associated second attachment locations.

14. In a screen printing machine including a head and at least one screen frame holding arm pivotally mounted on said head for movement about an axis toward and away from a platen to lowered printing and raised non-printing positions, respectively, and including primary spring means associated with said at least one arm, said primary spring means attached at one end to first attachment means located on said at least one arm and at another end to second attachment means located on said head for controlling the movement of said at least one arm; the improvement comprising secondary spring means for adjusting the spring rate of said primary spring means, wherein said secondary springs are mounted between, and are fastened at opposite ends to selected coils of said primary springs.

* * * * *